US009765781B2

(12) United States Patent
Murakami et al.

(10) Patent No.: US 9,765,781 B2
(45) Date of Patent: Sep. 19, 2017

(54) SCROLL COMPRESSOR

(75) Inventors: Yasuhiro Murakami, Sakai (JP); Masahiro Yamada, Sakai (JP); Kouji Kojima, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 96 days.

(21) Appl. No.: 13/522,929

(22) PCT Filed: Jan. 19, 2011

(86) PCT No.: PCT/JP2011/050870
§ 371 (c)(1),
(2), (4) Date: Jul. 18, 2012

(87) PCT Pub. No.: WO2011/090071
PCT Pub. Date: Jul. 28, 2011

(65) Prior Publication Data

US 2012/0288394 A1 Nov. 15, 2012

(30) Foreign Application Priority Data

Jan. 22, 2010 (JP) ..... 2010-012577

(51) Int. Cl.

| | |
|---|---|
| ***F01C 1/02*** | (2006.01) |
| ***F01C 1/063*** | (2006.01) |
| ***F04C 2/02*** | (2006.01) |
| ***F04C 18/02*** | (2006.01) |
| ***F01C 21/00*** | (2006.01) |

(52) U.S. Cl.
CPC ..... *F04C 18/0269* (2013.01)

(58) Field of Classification Search
CPC ..... F04C 18/0207; F04C 18/0246; F04C 18/0269
(Continued)

(56) References Cited

U.S. PATENT DOCUMENTS 5,425,626 A * 6/1995 Tojo et al. ..... 418/55.2
5,836,752 A * 11/1998 Calhoun et al. ..... 418/55.2
(Continued)

FOREIGN PATENT DOCUMENTS

JP 60-252102 A 12/1985
JP 3-149386 A 6/1991
(Continued)

OTHER PUBLICATIONS

European Search Report of corresponding EP Application No. 11 73 4677.5 dated Jun. 5, 2013.
(Continued)

*Primary Examiner* — Deming Wan
(74) *Attorney, Agent, or Firm* — Global IP Counselors, LLP

(57) ABSTRACT

A scroll compressor includes fixed and movable scrolls, each scroll having a spiral lap placed on one surface of a plate. The lap of the fixed scroll and the lap of the movable scroll are interlocked to form a compression chamber between the laps of the scrolls which are adjacent to each other. At least one of the laps has a spiral shape in which a base radius of an involute decreases as a winding angle increases in a region extending from a winding start part to a winding middle part, and the base radius of the involute in a region extending from the winding middle part to a winding end part is larger than the smallest value of the base radius of the involute in the region extending from the winding start part to the winding middle part.

10 Claims, 11 Drawing Sheets

(58) Field of Classification Search
USPC ..... 418/55.2, 150, 270, 55.3
See application file for complete search history.

(56) References Cited

U.S. PATENT DOCUMENTS

| | | | | |
|---|---|---|---|---|
| 5,857,844 | A * | 1/1999 | Lifson et al. | 418/1 |
| 6,132,179 | A * | 10/2000 | Higashiyama | 417/310 |
| 2002/0071780 | A1 | 6/2002 | Chang et al. | |
| 2005/0214148 | A1 | 9/2005 | Ogawa et al. | |
| 2008/0145253 | A1* | 6/2008 | Uekawa | 418/55.3 |
| 2010/0202910 | A1* | 8/2010 | Yamamoto et al. | 418/55.2 |

FOREIGN PATENT DOCUMENTS

| | | | |
|---|---|---|---|
| JP | 5-29796 | B2 | 5/1993 |
| JP | 9-126167 | A | 5/1997 |
| JP | 11-264387 | A | 9/1999 |
| JP | 2000-179478 | A | 6/2000 |
| JP | 2001-263274 | A | 9/2001 |
| JP | 2002-364562 | A | 12/2002 |
| JP | 2005-240699 | A | 9/2005 |
| JP | 2005-307964 | A | 11/2005 |
| JP | 2009-85154 | A | 4/2009 |

OTHER PUBLICATIONS

Japanese Office Action of corresponding Japanese Application No. 2011-008663 dated Aug. 21, 2012.

International Search Report of corresponding PCT Application No. PCT/JP2011/050870.

International Preliminary Report of corresponding PCT Application No. PCT/JP2011/050870, Jul. 24, 2012.

* cited by examiner

SCROLL COMPRESSOR

CROSS-REFERENCE TO RELATED APPLICATIONS

This U.S. National stage application claims priority under 35 U.S.C. §119(a) to Japanese Patent Application No. 2010-012577, filed in Japan on Jan. 22, 2010, the entire contents of which are hereby incorporated herein by reference.

TECHNICAL FIELD

The present invention relates to a scroll compressor.

BACKGROUND ART

Compressors in which an inverter motor is employed are common in scroll compressors used in outdoor units of air conditioners or the like in order to expand the range of performance; however, in order to obtain an even greater range of performance, operation at even higher levels of rotation is currently being demanded.

Nevertheless, an adverse effect of high-rotation operation is the increased likelihood that the spiral lap of the movable scroll or the like will be damaged.

Specifically, when high-rotation operation is performed, the centrifugal force of the orbiting movable scroll increases, and the centrifugal force of the movable scroll acts between a crankshaft constituting a drive shaft and a boss constituting a bearing portion of the movable scroll, or between the lap of the movable scroll and the lap of the fixed scroll.

The shape of the spiral laps may vary from the ideal in actual processing; in particular, since the winding end part on the outermost periphery of the lap of the moving scroll is in a state of being supported on one side, processing error readily arises, and contact is readily made with the lap of the fixed scroll.

If the winding end part on the outermost periphery of the lap of the fixed scroll is shaped as a thick, highly rigid block and not a thin blade, then when the laps of the movable scroll and the fixed scroll make contact, substantially no bending of the lap on the fixed scroll occurs; i.e., less stress-relief clearance is provided. The stresses visited on the corresponding lap of the movable scroll accordingly increase.

As described above, the centrifugal force applied to the movable scroll lap is increased by high-rotation operation, making it necessary for the lap to be shaped so as to be capable of withstanding the centrifugal force.

Examples of shapes widely known in the art for laps whose spiral shape is configured according to an involute curve include shapes where the wall thickness of the lap is fixed from the winding start part to the winding end part (i.e., the base radius of the involute is fixed), and/or shapes where the wall thickness of the lap decreases closer to the winding end part on the outermost periphery relative to the middle winding start part of the lap (i.e., the base radius of the involute decreases).

Therefore, in order to improve the strength of the winding end part of the lap in the scroll compressor taught in Japanese Examined Patent Application No. 5-29796, the wall thickness of the lap is fixed from the winding start part to the winding end part, but a protruding part is provided on the outside of the lap on the winding end part of the lap of the movable scroll.

Moreover, according to the scroll compressor taught in Japanese Unexamined Publication No. 2000-179478, the wall thickness of the lap is constant from the winding start part to the winding end part, but the winding end part of the lap of the movable scroll is extended, and the plate thickness is less than the other portions of the lap.

SUMMARY

Technical Problem

As described above, if the wall thickness of the lap is reduced toward the winding end part relative to the winding start part (when the base radius of the involute is reduced as the lap winding angle increases), a problem is presented in that the strength of the winding end part of the lap decreases (refer to FIG. 11).

On the other hand, even if the wall thickness of the lap is fixed (the base radius of the involute is fixed), increasing the wall thickness of the lap in order to improve the strength of the winding end part presents a problem in that the compression mechanism must be increased in size in order for its capacity to remain the same. If the lap is reduced in height in order to improve strength, the same problem will be presented in that the compression mechanism must be increased in size in order for its capacity to remain the same.

In order to improve the strength of the winding end part of the lap of the movable scroll, if the outside of the winding end part of the lap is caused to bulge outward, or the winding end part of the lap is extended as described in Japanese Examined Patent Application No. 5-29796 and Japanese Unexamined Publication No 2000-179478, more space will be needed to avoid interference with the fixed scroll, and the problem is again presented that the compression mechanism must be increased in size. Another problem is presented in that pressure loss in the intake step increases, and efficiency is adversely affected.

If the wall thickness of the extension of the winding end part of the lap is reduced, then if the extension is increased in length, but the distance from the loading point to the end of the extension is not increased (i.e., if a double-sided support state is not produced), the stress generated in the thin part will increase. A problem is accordingly presented in that the compression mechanism must be increased in size. Another problem is that pressure toss in the intake process increases, and efficiency is adversely affected.

It is an object of the present invention to provide a scroll compressor allowing the strength of the winding end part of the lap to be improved and the size of the compression mechanism to be reduced.

Solution to Problem

A scroll compressor according to a first aspect of the present invention comprises a fixed scroll and a movable scroll. Each of the fixed scroll and the movable scroll is a member in which a spiral lap is placed on one surface of a plate. By interlocking the lap of the fixed scroll and the lap of the movable scroll lap, a compression chamber is formed between the lap of the fixed scroll and the lap of the movable scroll which are adjacent to each other. At least one of the laps of the fixed scroll or the movable scroll describes a spiral shape in which a base radius of an involute decreases as a winding angle increases in a region extending from a winding start part of the lap to a winding middle part of the lap. In addition, in a region extending from the winding middle part of the one of the laps to a winding end part of the lap, the lap describes a spiral shape in which the base radius of the involute is larger than the smallest value of the base radius of the involute in the region extending from the winding start part of the lap to the winding middle part.

According to this scroll compressor, making the base radius of the involute smaller in the region extending from the winding start part of the lap of at least one of the fixed scroll or the movable scroll to the winding middle part reduces the wall thickness and successfully reduces the size of the compression mechanism. In addition, by having the base radius of the involute in the region extending from the winding middle part of the lap to the winding end part larger than the minimum value of the base radius of the involute in the region extending from the winding start part of the lap to the winding middle part, the wall thickness of the winding end part is maintained and the strength of the winding end part is improved. Therefore, according to this scroll compressor, it is possible to reduce the size of the compression mechanism and improve the strength of the winding end part.

A scroll compressor according to a second aspect of the present invention comprises a fixed scroll and a movable scroll. Each of the fixed scroll and the movable scroll is a member in which a spiral lap is placed on one surface of a plate. By interlocking the lap of the fixed scroll and the lap of the movable scroll lap, a compression chamber is formed between the lap of the fixed scroll and the lap of the movable scroll which are adjacent to each other. At least one of the laps of the fixed scroll or the movable scroll describes a spiral shape in which a base radius of an involute decreases as a winding angle increases in a region extending from a winding start part of the lap to a winding middle part of the lap. In addition, in a region extending from the winding middle part of the one of the laps to a winding end part of the lap, the lap describes a spiral shape in which the base radius of an inner involute of the lap decreases and the base radius of an outer involute of the lap either increases or stays constant as the winding angle increases. Or, in a region extending from the winding middle part of the one of the laps to the winding end part of the lap, the lap describes a spiral shape in which the base radius of the inner involute of the lap stays constant and the base radius of the outer involute of the lap either increases or stays constant as the winding angle increases.

According to this scroll compressor, the shape of at least one lap of the fixed scroll or the movable scroll is such that, in the region from the winding middle part of the lap to the winding end part, the base radius of the inner involute of the tap decreases or becomes fixed, while the base radius of the outer involute of the lap increases or becomes fixed. Here, "inner" and "outer" respectively mean the inside or outside of the plate in the radial direction, and these meanings are retained below. According to this scroll compressor, the wall thickness of the winding end part is maintained and the strength of the winding end part is improved. Therefore, according to this scroll compressor, it is possible to reduce the size of the compression mechanism and improve the strength of the winding end part.

A scroll compressor according to a third aspect of the present invention is the scroll compressor according to the first or second aspect, wherein the winding middle part of the lap ranges from an inner middle point to an outer middle point. The inner middle point is a point positioned a half to one lap-turn away from an outer involute start point of the lap toward an outer involute end point of the lap. The outside middle point is a point positioned a half to one lap-turn away from the outer involute end point of the lap toward the outer involute start point of the lap. The "outer involute start point of the lap" means an end point on the inside of the involute curve in the radial direction with respect to a top view of a wall surface of the lap on the outside in the radial direction. The "outer involute end point of the lap" means an end point on the outside of the involute curve in the radial direction with respect to a top view of a wall surface of the lap on the outside in the radial direction. The point "positioned a half to one lap-turn away" means a point set apart by a half to one rotation along the involute curve.

According to this scroll compressor, the winding middle part of the lap corresponds to the range of the entire lap excluding the half-turn to one-turn portion of the lap from the winding start part, and the half-turn to one-turn portion of the lap from the winding end part. Therefore, it is possible to reliably achieve a reduction in the size of the compression mechanism and an improvement in the strength of the winding end part.

A scroll compressor according to a fourth aspect of the present invention is the scroll compressor according to any one of the first through third aspects, wherein the lap describes a spiral shape in which a winding angle at a compression-chamber-formation point is smaller than a winding angle at an inner involute end point of the lap. The compression-chamber-formation point is a point where an outermost compression chamber is formed, the point being included in the outer involute of the lap, and the point nearest to the outer involute end point of the lap. The outermost compression chamber is a compression chamber positioned on the outermost of the plate in a radial direction. The "inner involute end point of the lap" means an end point of the outside of the involute curve in the radial direction with respect to a top view of a lap wall surface on the inside in the radial direction.

According to this scroll compressor, at the winding end part of the lap, the winding angle at the compression-chamber-formation point on the outside of the lap is smaller than the winding angle at the inner involute end point of the lap. The lap is thereby doubly supported at the winding end part thereof; therefore, stress generated at the base of the winding end part of the lap can be relieved. As a result, the strength of the winding end part can be improved. Moreover, the difference in pressure in the compression chambers on the inside and outside of the lap can be reduced, and the efficiency of the compressor can be improved.

A scroll compressor according to a fifth aspect of the present invention is the scroll compressor according to any one of the first through fourth aspects, wherein a counter-sunk part is formed on a surface of the plate of the movable scroll, the surface being on the opposite side of the surface where the lap is placed.

According to this scroll compressor, since the counter-sunk part is formed on the surface of the plate of the movable scroll on the side apposite the lap, the weight of the movable scroll can be reduced.

A scroll compressor according to a sixth aspect of the present invention is the scroll compressor according to any one of the first through fifth aspects, wherein a radial direction gap between an inner peripheral surface of the lap of the fixed scroll and an outer peripheral surface of the lap of the movable scroll in a range corresponding to one lap-turn from the winding end part of the lap of the movable scroll is larger than the radial direction gap near the winding start part of the lap.

According to this scroll compressor, since the radial direction gap between an inner peripheral surface of the lap of the fixed scroll and an outer peripheral surface of the lap of the movable scroll in a range corresponding to one lap-turn from the winding end part of the lap of the movable scroll is larger than the radial direction gap in the vicinity of the winding start part of the lap, it is possible to relieve the contact load received by the winding end part of the lap of the movable scroll when contact is made with a high-rigidity portion near the winding end part of the lap of the fixed scroll.

A scroll compressor according to a seventh aspect of the present invention is the scroll compressor according to the sixth aspect, wherein the radial direction gap δ between the inner peripheral surface of the lap of the fixed scroll and the outer peripheral surface of the lap of the movable scroll in the range corresponding to one lap-turn from the winding end part of the lap of the movable scroll is in a range expressed as: $(L-T-D\times2)\leq\delta\leq(L-T-D\times2+P+M)$ where L is a groove width of the fixed scroll, T is a wall thickness of the movable scroll, D is a turning radius of the movable scroll, P is a pin bearing gap between a boss of the movable scroll and a pin shaft part of a crankshaft connected thereto, and M is a main bearing gap between the crankshaft and a main bearing supporting the crankshaft.

According to this scroll compressor, the radial direction gap δ at least at the seal point, which is a point where the laps contact one another and seal the compression chamber, is set so as to be approximately 0. In order to minimize any drop in performance, there is set a radial direction gap δ that is equal to or less than a clearance at which the pin bearing gap and the main bearing gap are at a maximum, making it possible to reliably ensure the gap between the laps is kept at 0 or more.

Advantageous Effects of Invention

In the scroll compressor according to the first to third aspects of the present invention, it is possible to reduce the size of the compression mechanism while improving the strength of the winding end part of the lap.

In the scroll compressor according to the fourth aspect of the present invention, stress generated at the base of the winding end part of the lap can be relieved; and, as a result, the strength of the winding end part can be improved. Moreover, the difference in pressure in the compression chambers on the inside and outside of the lap can be reduced, and the efficiency of the compressor can be improved.

In the scroll compressor according to the fifth aspect of the present invention, the movable scroll can be reduced in weight.

In the scroll compressor according to the sixth aspect of the present invention, the contact load experienced when contact is made between the winding end part of the lap of the movable scroll and the high-rigidity portion near the winding end part of the lap of the fixed scroll can be relieved.

In the scroll compressor according to the seventh aspect of the present invention, the gap between the laps can be reliably kept at 0 or higher, and any drop in compressor performance can be minimized.

DESCRIPTION OF EMBODIMENTS

Embodiments

An embodiment of the scroll compressor shall now be described with reference to the drawings.

Figure 1:
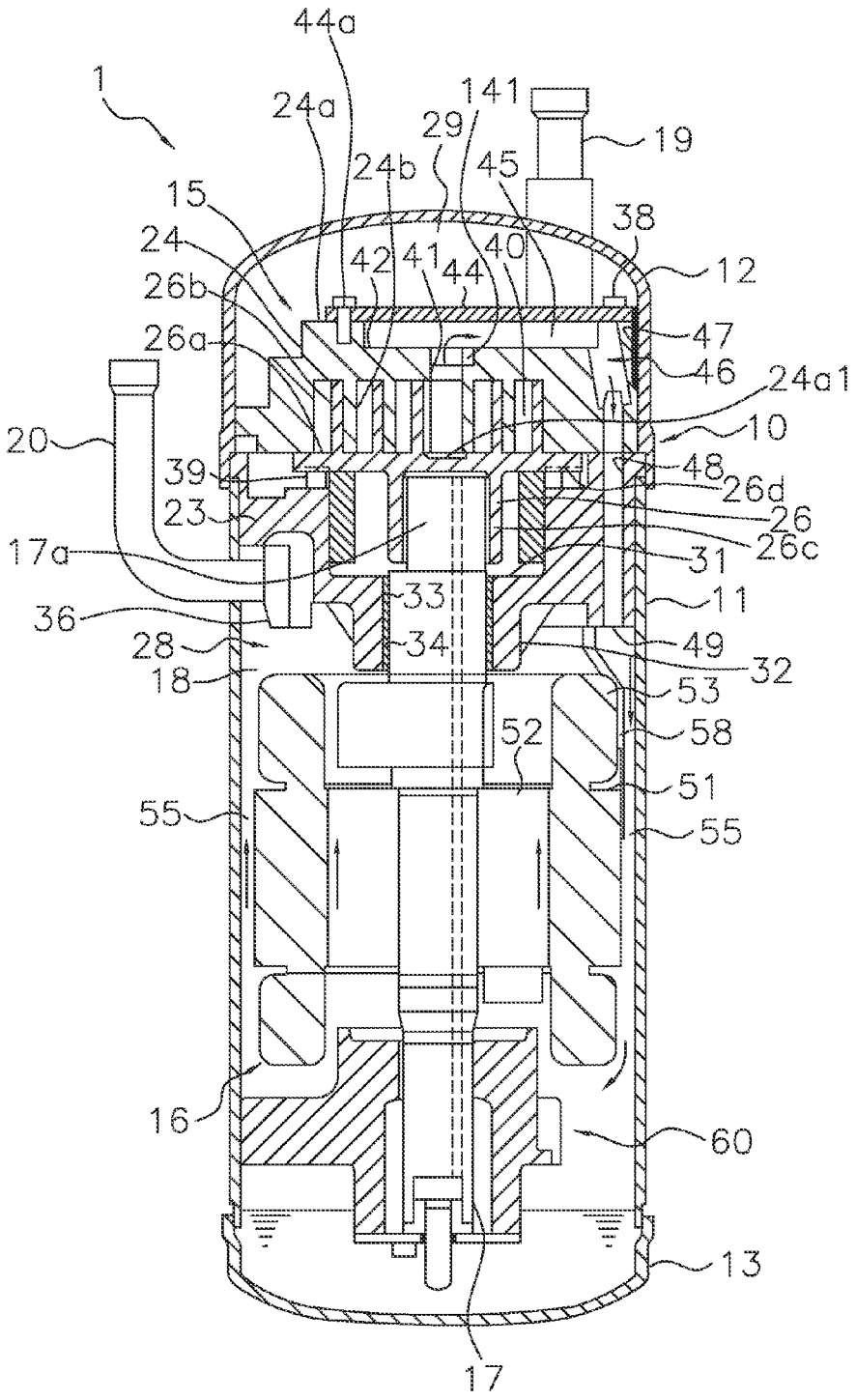
FIG. 1 is a top view of the scroll compressor according to an embodiment of the present invention.

A scroll compressor 1 represented in FIG. 1 is a high/low-pressure-dome-type scroll compressor constituting a refrigerant circuit together with an evaporator, a condenser, an expansion mechanism and others. The scroll compressor serves the function of compressing a gas refrigerant inside the refrigerant circuit; and mainly comprises an airtight-dome-type casing 10 describing a vertically elongated cylindrical shape, a scroll compression mechanism 15, an Oldham coupling 39, a drive motor 16, a lower main bearing 60, an intake tube 19, and a discharge tube 20. Each of the components of the scroll compressor shall be described in detail below.

(Detailed Description of Components Constituting the Scroll Compressor 1)

(1) Casing

The casing 10 has a substantially cylindrical middle casing part 11, a bowl-shaped upper wall part 12 hermetically welded to a top end part of the middle casing part 11, and a bowl-shaped lower wall part 13 hermetically welded to a lower end part of the middle casing part 11. Accommodated in the casing 110 are, mainly, a scroll compression mechanism 15 for compressing the gas refrigerant, and a drive motor 16 arranged below the scroll compression mechanism 15. The scroll compression mechanism 15 and the drive motor 16 are connected by a crankshaft 17 arranged so as to extend within the casing 10 in a vertical direction. As a result, a gap 18 is present between the scroll compression mechanism 15 and the drive motor 16.

(2) Scroll Compression Mechanism

As represented in FIG. 1, the scroll compression mechanism 15 mainly comprises a housing 23, a fixed scroll 24 tightly attached and arranged above the housing 23, and a movable scroll 26 that meshes with the fixed scroll 24. In order to increase volume and/or improve efficiency, spiral laps 24*b*, 26*b* of the fixed scroll 24 and the movable scroll 26, respectively, are in an asymmetric configuration in the scroll compression mechanism 15. The lap 24*b* of the fixed scroll 24 extends about a half more around in the inner side, compared to the lap 26*b* of the movable scroll 26.

The components of the scroll compression mechanism 15 shall now be described in detail.

(2-1) Fixed Scroll

Figure 2:
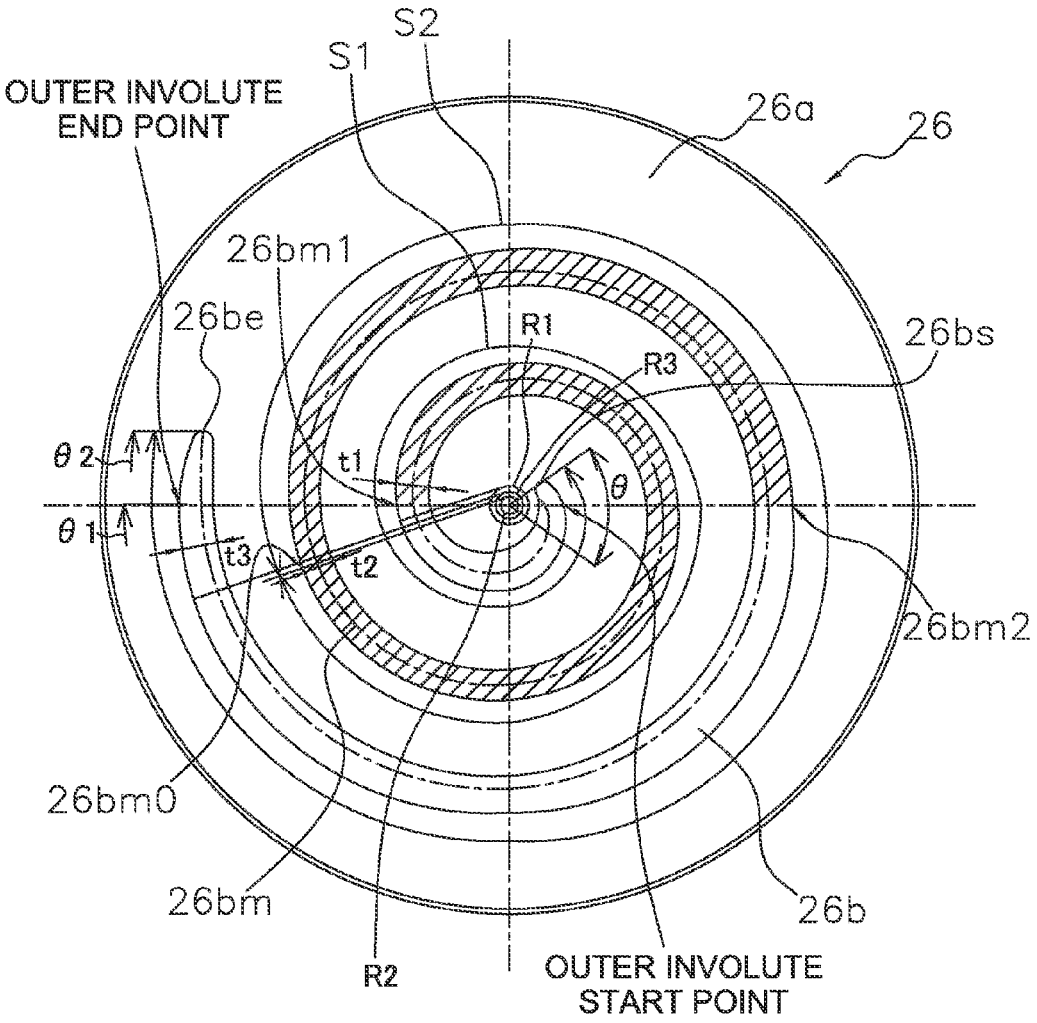
FIG. 2 is a top view representing the shape of the lap of the movable scroll of FIG. 1.
Figure 3:
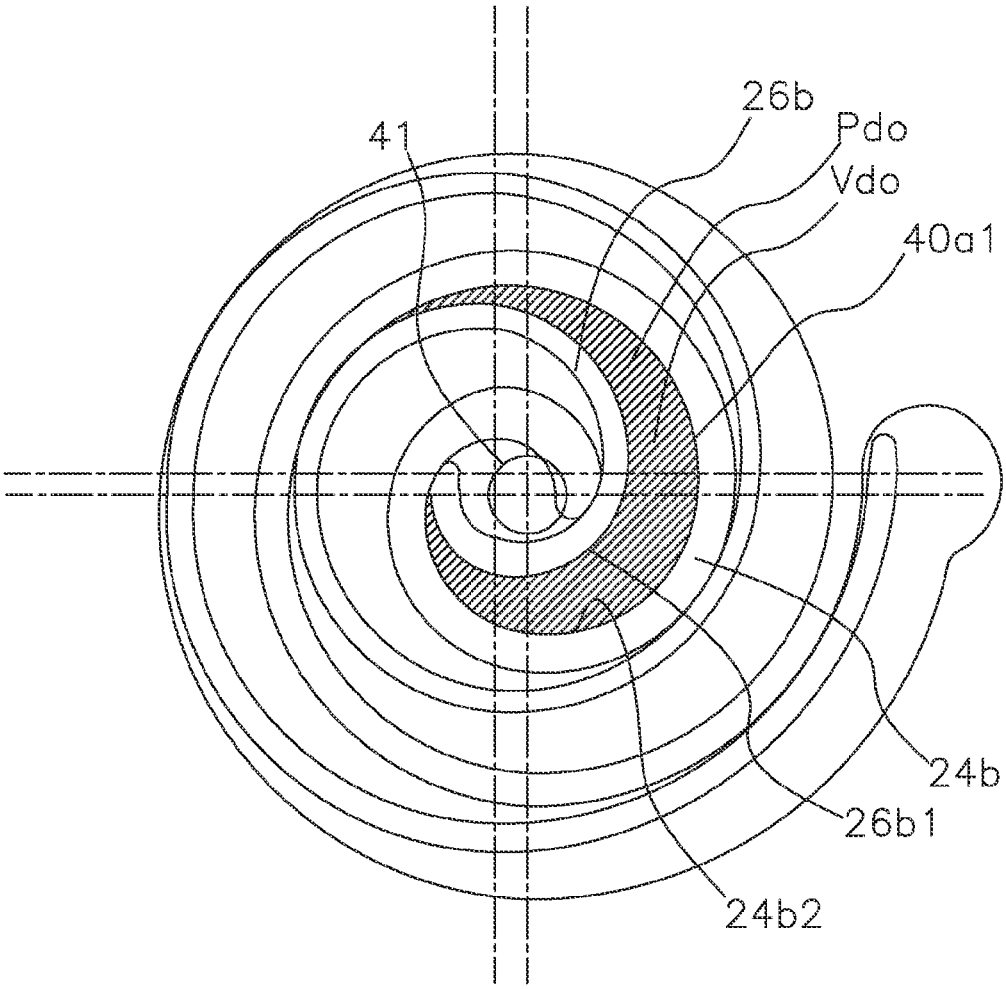
FIG. 3 is a top view representing the position immediately prior to discharging of gas in the compression chamber formed on the outside of the lap of the movable scroll of FIG. 1.

As represented in FIG. 1 through 3, the fixed scroll 24 mainly comprises a tabular-shaped plate 24*a*, and a spiral (involute-shaped) lap 24*b* formed on a lower surface of the plate 24*a*.

A discharge orifice 41 communicating with a compression chamber 40 (described later) is formed on the plate 24*a* penetrating to substantially the center of the plate 24*a*. The discharge orifice 41 is formed in a central portion of the plate 24*a* so as to extend in a vertical direction.

An enlarged recess 42 communicating with the discharge orifice 41 (refer to FIG. 1) is formed on the top surface of the plate 24*a*. The enlarged recess 42 comprises a horizontally widening recess provided on a top surface of the plate 24*a*. A lid body 44 is securely fastened to the top surface of the fixed scroll 24 by a bolt 44*a* so as to block the enlarged recess 42. Covering the enlarged recess 42 with the lid body 44 forms a muffler space 45 comprising an expansion chamber for silencing the operational noise made by the scroll compression mechanism 15. The fixed scroll 24 and the lid body 44 are tightly bonded interposed by a gasket (not shown) and thereby sealed.

(2-2) Movable Scroll

As represented in FIG. 1, the movable scroll 26 mainly comprises a plate 26*a*, a spiral (involute-shaped) lap 26*b* formed on the top surface of the plate 26*a*, a boss 26*c* constituting a bearing part formed on the lower surface of the plate 26*a*, and a key groove 26*d* (refer to FIG. 8) formed on both edges of the plate 26*a*. The boss 26*c* fits onto the outside of a pin shaft part 17*a* of a crankshaft 17.

A key part (not shown) of an Oldham coupling 39 is fitted into a key groove 26*d*, whereby the movable scroll 26 is supported by the housing 23. The pin shaft part 17*a* constituting an upper edge part of the crankshaft 17 is fittably inserted into the boss 26*c*. By being thus incorporated into the scroll compression mechanism 15, the movable scroll 26 is made to orbit inside the housing 23 and not to spin by the rotation of the crankshaft 17. The lap 26*b* of the movable scroll 26 is caused to mesh with the lap 24*b* of the fixed scroll 24, and a compression chamber 40 is formed between contacting parts of laps 24*b*, 26*b*. In the compression chamber 40, the volume between the laps 24*h*, 26*b* decreases toward the center as the movable scroll 26 orbits. In the scroll compressor 1 according to the present embodiment, gas refrigerant is thus compressed.

Figure 4:
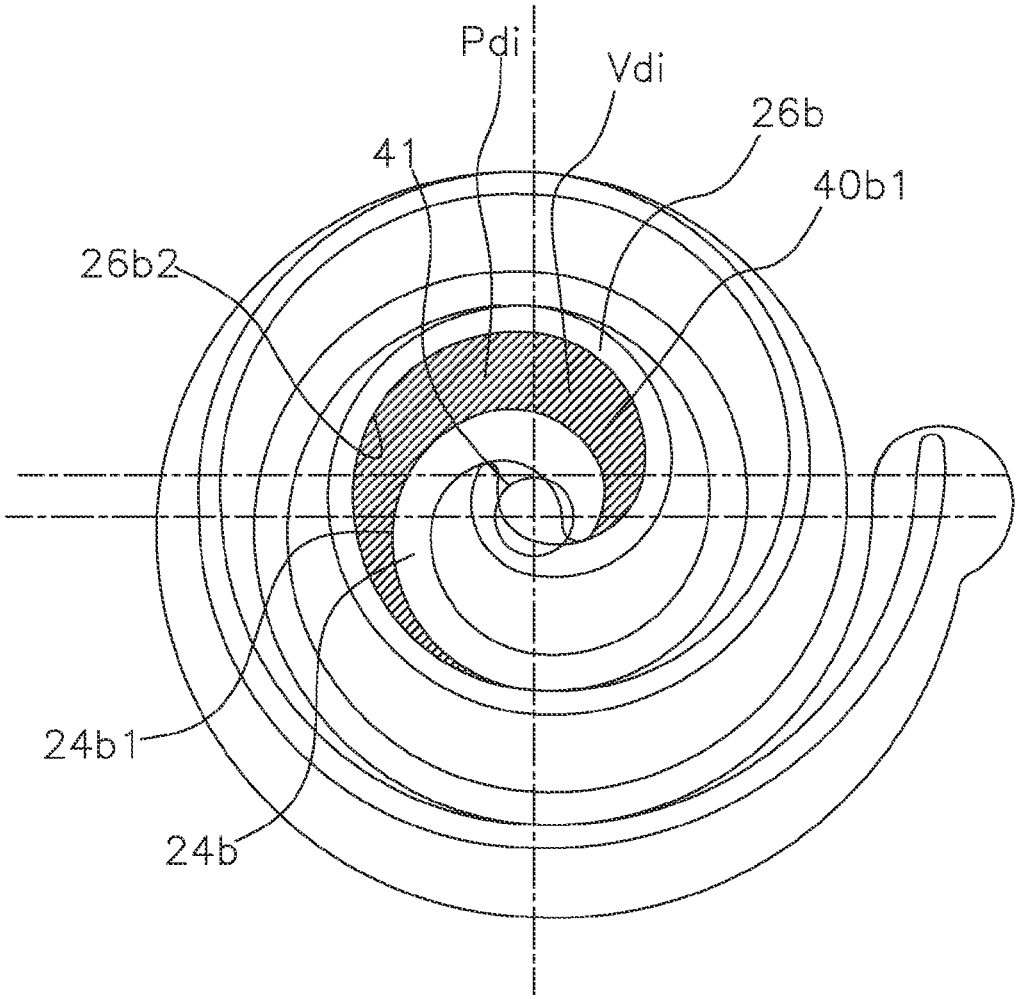
FIG. 4 is a top view representing the position immediately prior to discharging of gas in the compression chamber formed on the inside of the lap of the movable scroll of FIG. 1.

In the compression chamber 40, the volume changes according to the position where the movable scroll 26 orbits, there being an A chamber 40*a*1 and a B chamber 40*b*1 in the position immediately before discharging near the discharge orifice 41 at substantially the center of the fixed scroll 24. As represented in FIG. 3, the A chamber 40*a*1 is formed by being surrounded by an outside peripheral surface 26*b*1 of the lap 26*b* of the movable scroll 26 and an inside peripheral surface 24*b*2 of the lap 24*b* of the fixed scroll 24. As represented in FIG. 4, the B chamber 40*b*1 is formed by being surrounded by an inside peripheral surface 26*b*2 of the lap 26*b* of the movable scroll 26 and an outside peripheral surface 24*b*1 of the lap 24*b* of the fixed scroll 24.

After the A chamber 40*a*1 represented in FIG. 3 is formed, high-pressure gas compressed inside the A chamber 40*a*1 flows, when the orbit of the movable scroll 26 advances further, to the discharge orifice 41 through a gap between the central end of the lap 26*b* of the movable scroll 26 and the inside peripheral surface of the lap 24*b* of the fixed scroll 24.

After the B chamber 40*b*1 represented in FIG. 4 is formed, high-pressure gas compressed inside the B chamber 40*b*1 flows, when the orbit of the movable scroll 26 progresses further, to the discharge orifice 41 through a gap between the central end of the lap 24*b* of the fixed scroll 24 and the inside peripheral surface of the lap 26*b* of the movable scroll 26 and a countersunk recess 24*a*1 (refer to FIG. 1) formed substantially near the center of the plate 26*a* of the movable scroll 26.

As represented in FIG. 2, the base radius of the involute of the lap 26*b* of the movable scroll 26 of the present embodiment decreases as a winding angle θ of only region S1 extending from a winding start part 26*bs* of the lap 26*b* to a winding middle part 26*bm* (the rotation angle from the winding start part 26*bs*) increases.

For example, in FIG. 2, a base radius R2 of the involute in the winding middle part 26*bm* is smaller than a base radius R1 of the involute near the winding start part 26*bs* (i.e., R2<R1). Correspondingly, the wall thickness t2 in the winding middle part 26*bm* of the lap 26*b* is smaller than the wall thickness t1 near the winding start part 26*bs* (i.e., t2<t1).

Thus, the base radius R2 of the involute is made smaller only in the region extending from the winding start part 26*bs* of the lap 26*b* to the winding middle part 26*bm*; and, in association therewith, the wall thickness t2 is made smaller. Therefore, it is possible to achieve a reduction in the size of the scroll compression mechanism 15.

In region S2 extending from the winding middle part 26*bm* to a winding end part 26*be*, the base radius of the involute increases as the winding angle θ increases. In FIG. 2, e.g., the base radius R2 of the involute in the winding middle part 26*bm* is smaller than a base radius R3 of the involute near the winding end part 26*be* (i.e., R2<R3). Correspondingly, the wall thickness t2 in the winding middle part 26*bm* of the lap 26*b* is smaller than the wall thickness t3 near the winding end part 26*be* (i.e., t2<t3). In FIG. 2, the base radius of the involute is expressed as R2<R3<R1, and the wall thickness is expressed as t2<t3<t1.

Thus, in region S2 extending from the winding middle part 26*bm* to the winding end part 26*be*, the base radius R3 of the involute is made larger, and it is accordingly possible to ensure the winding end part 26*be* has the wall thickness t3, and to improve the strength of the winding end part 26*be*.

Figure 11:
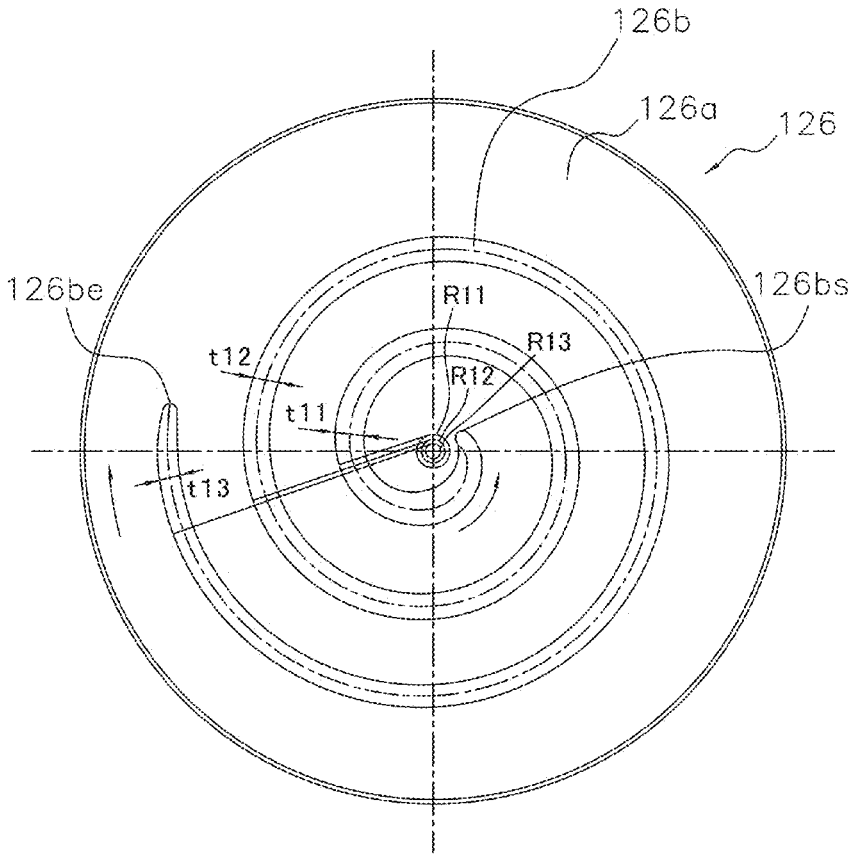
(PRIOR ART) FIG. 11
FIG. 11 is a top view representing the arrangement of the lap of the movable scroll where the base radius of the involute decreases from the winding start part to the winding end part of the lap, as a comparative example.

As a comparative example, the base radius of the involute of a lap 126*b* of a conventional movable scroll 126 represented in FIG. 11 decreases (R11>R12>R13) as the winding angle increases from a winding start part 126*bs* to a winding end part 126*be*; therefore, the wall thickness also decreases correspondingly (t11>t12>t13). As a result, a wall thickness t13 of the winding end part 126*be* of the lap 126*b* decreases, and the strength of the winding end part 126*be* is not readily ensured.

Moreover, as represented in FIG. 2, the winding middle part 26*bm* of the lap 26*b* ranges from an inside edge part 26*bm*1 to an outside edge part 26*bm*2. Below, the end point on the inside of the involute curve in the radial direction with respect to a top view of a wall surface of the lap 26*b* on the outside in the radial direction is called "the involute start point." The end point on the outside of the involute curve in the radial direction with respect to a top view of a wall surface of the lap 26*b* on the outside in the radial direction is called "the involute end point." According to the present embodiment, the inside edge part 26*bm*1 is a point advanced by half a rotation along the involute curve from the involute start point toward the involute end point. The outside middle point is a point advanced by half a rotation along the involute curve from the involute end point toward the involute start point. Namely, the winding middle part 26*bm* of the lap 26*b* is the range of the entire lap 26*b* excluding the range corresponding to a half tap-turn from the winding start part 26*bs* (the range from the involute start point on the outside to the inside edge part 26*bm* 1 in FIG. 2) and the range corresponding to a half lap-turn from the winding end part 26*be* (the range from the outer involute end point to the outside edge part 26*bm*2 in FIG. 2) (the range of the diagonal-line portion represented in FIG. 2). Included within the range of the winding middle part 26*bm* is an extremely small point 26*bm*0, where the base radius of the involute is smallest.

If the winding middle part 26*bm* includes the range extending from a point positioned a half lap-turn away from the winding start part 26*bs* toward the winding start part 26*bs*, it will be difficult to achieve a reduction in the size of the scroll compression mechanism 15. On the other hand, if the winding middle part 26*bm* includes the range extending from a point positioned a half lap-turn away from the winding end part 26*be* toward the winding end part 26*be*, it will be difficult to improve the strength of the winding end part 26*be*. The above range is commercially preferred in order to reliably achieve a reduction in the size of the scroll compression mechanism 15 and an improvement in the strength of the winding end part 26*be*.

Figure 5:
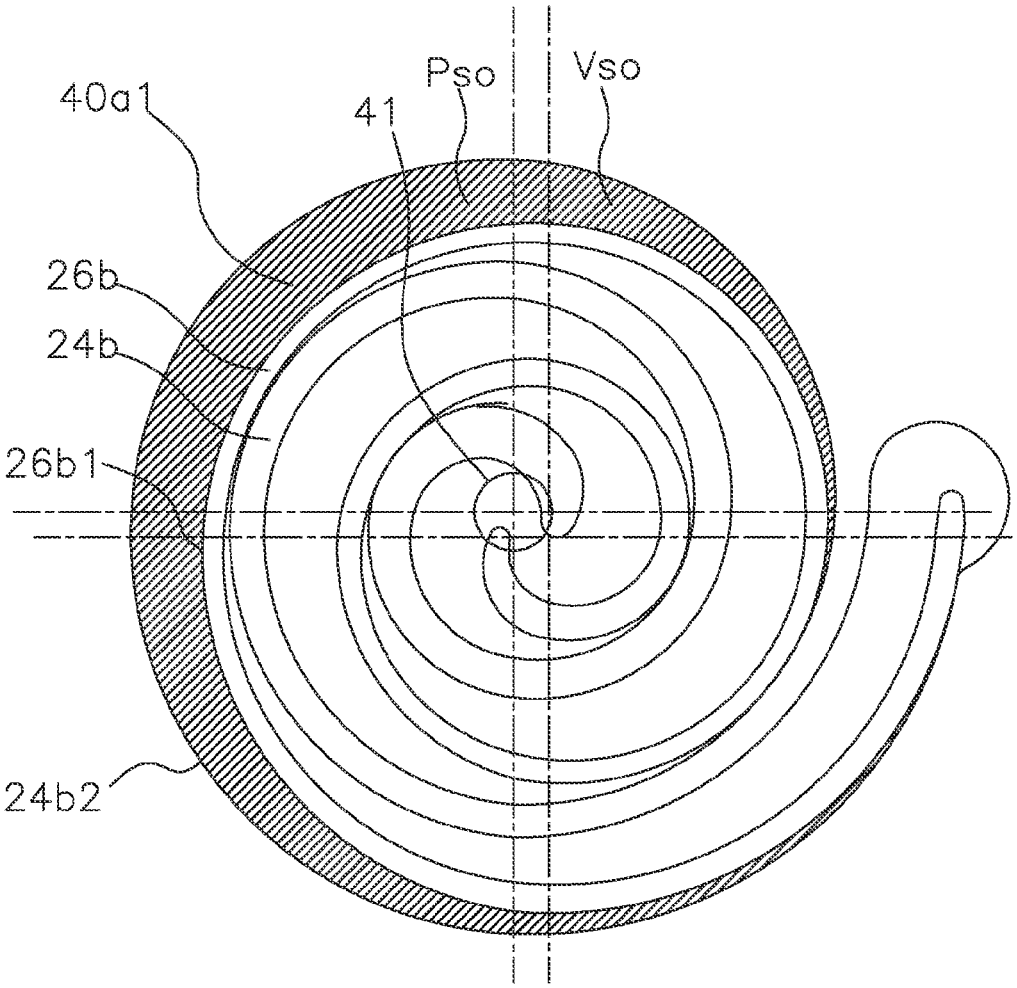
FIG. 5 is a top view representing the position immediately after gas in the compression chamber formed on the outside of the lap of the movable scroll of FIG. 1 has finished being taken into the compression chamber.
Figure 6:
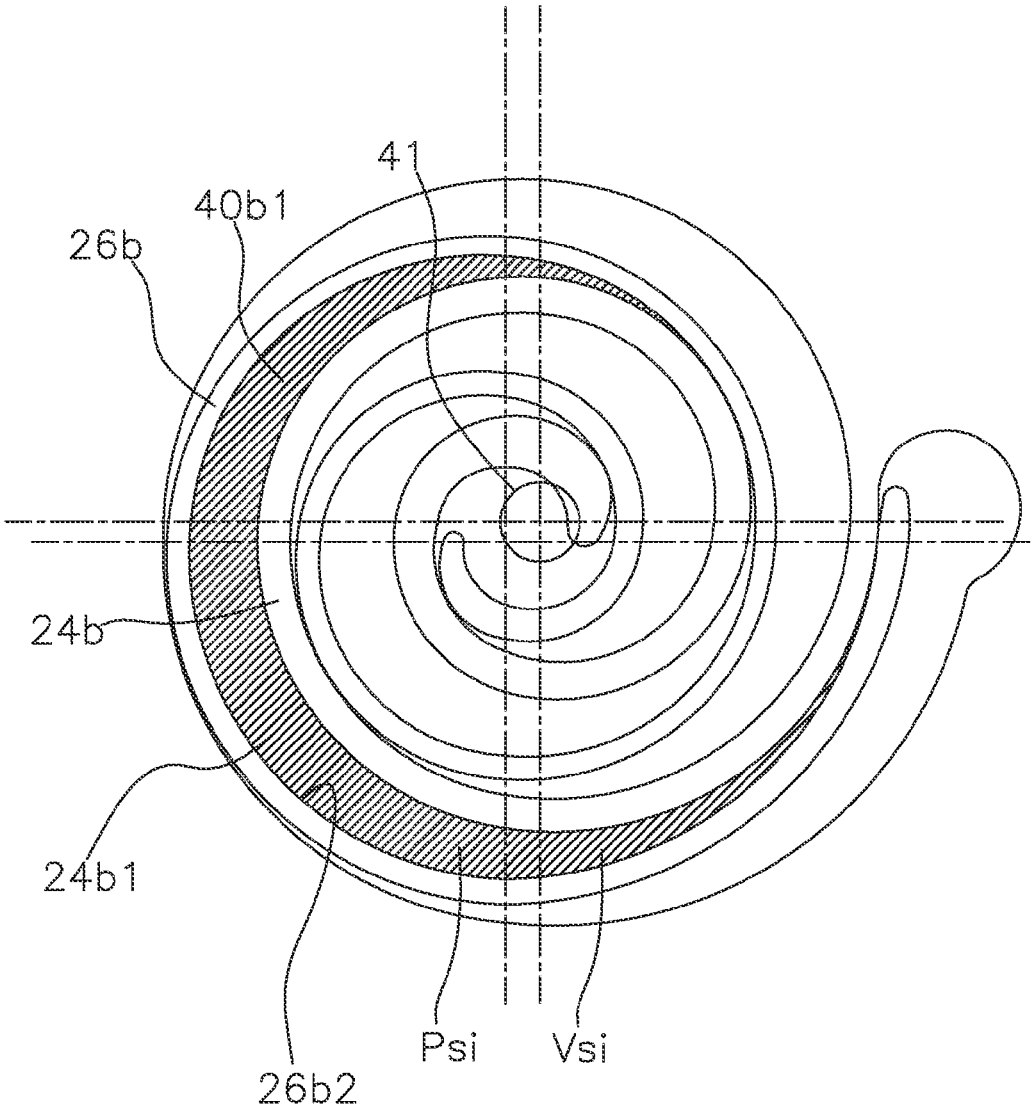
FIG. 6 is a top view representing the position immediately after gas in the compression chamber formed on the inside of the lap of the movable scroll of FIG. 1 has finished being taken into the compression chamber.
Figure 9:
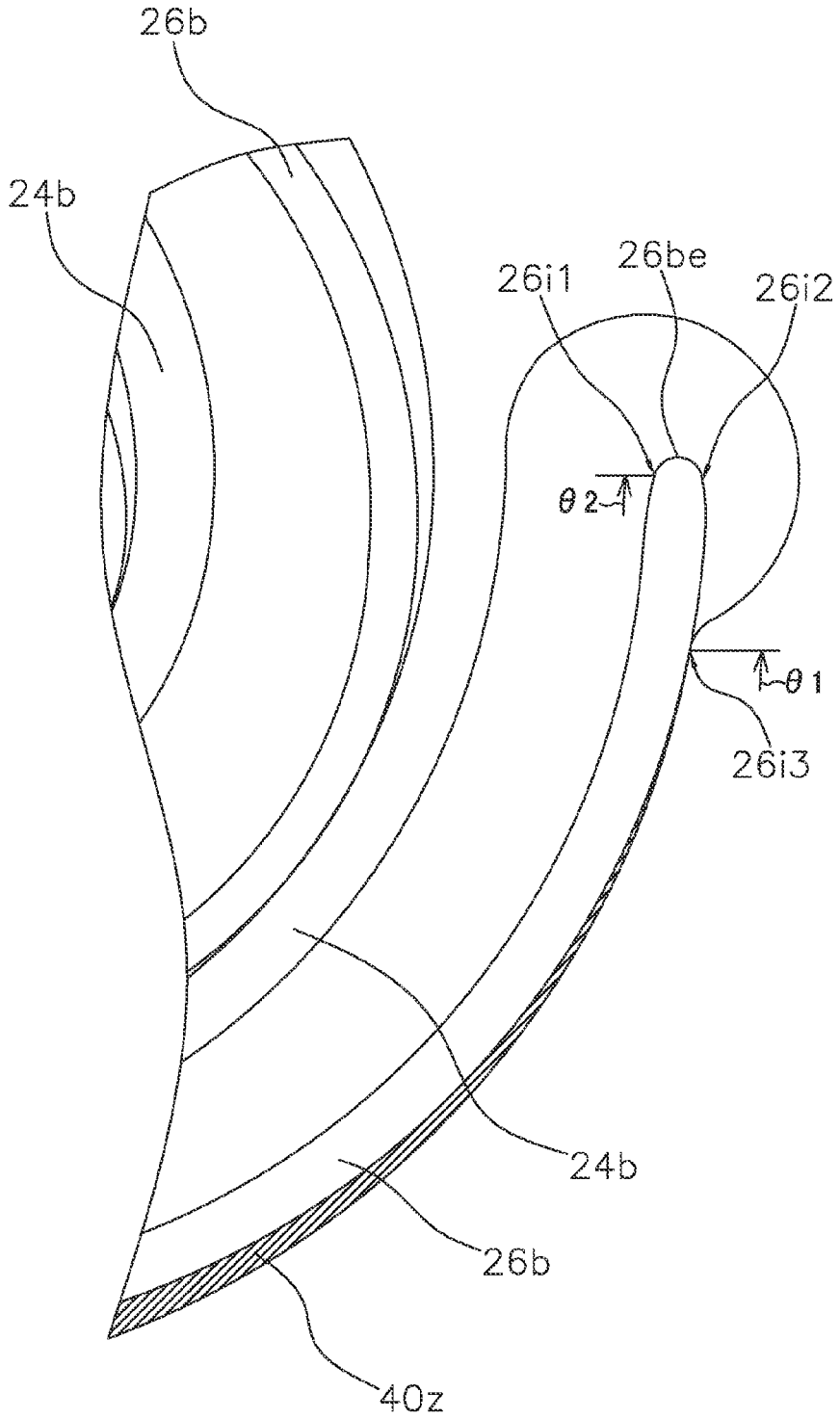
FIG. 9 is an enlarged view of the vicinity of the compression chamber formed on the outermost side of the lap of the movable scroll of FIG. 1.

As represented in FIG. 9, the lap 26*b* describes a shape obtained by making a winding angle θ1 of a compression-chamber-formation point 26*i*3 positioned on the involute curve on the outside the lap 26*b* smaller than a winding angle θ2 of the inner involute end point of the lap 26*b* (in FIG. 9, the point represented by 26*i*1) on the winding end part 26*be* of the lap 26*b*. The compression-chamber-formation point 26*i*3 is a point where an outermost compression chamber 40*z* is formed, and is nearest the outer involute end point of the lap 26*b* (in FIG. 9, the point represented by 26*i*2). The outermost compression chamber 40*z* is a compression chamber on the outermost side in the radial direction of the plate 26*a* of the movable scroll 26 (in FIG. 5, the outermost compression chamber is the compression chamber 40*a*1). The compression chamber formation point 26*i*3 is the point where the lap 26*b* of the movable scroll 26 and the lap 24*b* of the fixed scroll 24 come closest together. The compression chamber formation point 26*i*3 is different from the winding end part point 26*i*2 of the involute on the outside of the lap 26*b*. According to the present embodiment, having winding angle θ1 made smaller than winding angle θ2 makes it possible for contact to be made with a high-rigidity part of the outermost periphery of the lap 24*b* of the fixed scroll 24, and for an extension portion to be provided on an end edge of the lap 26*b* of the movable scroll 26 having a one-side-supported structure. Therefore, the winding end part 26*be* of the lap 26*b* is supported on both sides, and stress generated at the base of the winding end part 26*be* of the lap 26*b* can be relieved as a result. Moreover, there is a decrease in the difference between the built-in compression ratio of the compression chamber 40 formed by the lap on the inside of the movable scroll 26 and the built-in compression ratio of the compression chamber 40 formed by the lap on the outside of the movable scroll 26, and since the pressure difference between the inside compression chamber and the outside compression chamber can be reduced, leakage loss is reduced and efficiency can be improved.

Specifically, as represented in FIGS. 3 through 6, the following relationship is obtained when the volumetric ratio is examined:

$$(Vsi/Vdi)<(Vso/Vdo) \quad \text{(Formula 1)}$$

where Vdo is the volume of the A chamber 40*a*1 constituting the compression chamber 40 on the outside of the lap 26*b* immediately before discharging from the discharge orifice 41, and Pdo is the pressure of the A chamber 40*a*1 then (refer to FIG. 3); Vdi is the volume of the B chamber 40*b*1 constituting the compression chamber 40 on the inside of the lap 26*b* immediately before discharging from the discharge orifice 41, and Pdi is the pressure of the B chamber 40*b*1 then (refer to FIG. 4); Vso is the volume of the A chamber 40*a*1 of the lap 26*b* at the conclusion of intake, and Pso is the pressure of the A chamber 40*a*1 then (refer to FIG. 5); and Nisi is the volume of the B chamber 40*b*1 at the conclusion of intake, and Psi is the pressure of the B chamber 40*b*1 then (refer to FIG. 4), the compression ratio of the A chamber 40*a*11 on the outside being larger than that of the B chamber 40*b*1 on the inside.

Therefore, the pressure immediately before discharging is expressed by the relationship:

$$Pdi<Pdo \quad \text{(Formula 2)}$$

the pressure being higher in the A chamber 40*a*1 on the outside than in the B chamber 40*b*1 on the inside.

Therefore, in the present embodiment, by increasing the base radius R2 of the involute of the outside of the lap 26*b*, or making the winding angle θ1 of the outer involute end point of the tap 26*b* smaller than the winding angle θ2 of the inner involute end point of the lap 26*b* at the winding end part 26*be*, it is possible to reduce the difference between the built-in compression ratio of the compression chamber 40 formed by the lap on the inside of the movable scroll 26 and the built-in compression ratio of the compression chamber 40 formed by the lap on the outside of the movable scroll 26, and to reduce the pressure difference between the inside compression chamber and the outside compression chamber. As a result, leakage loss is reduced and efficiency can be improved.

Figure 8:
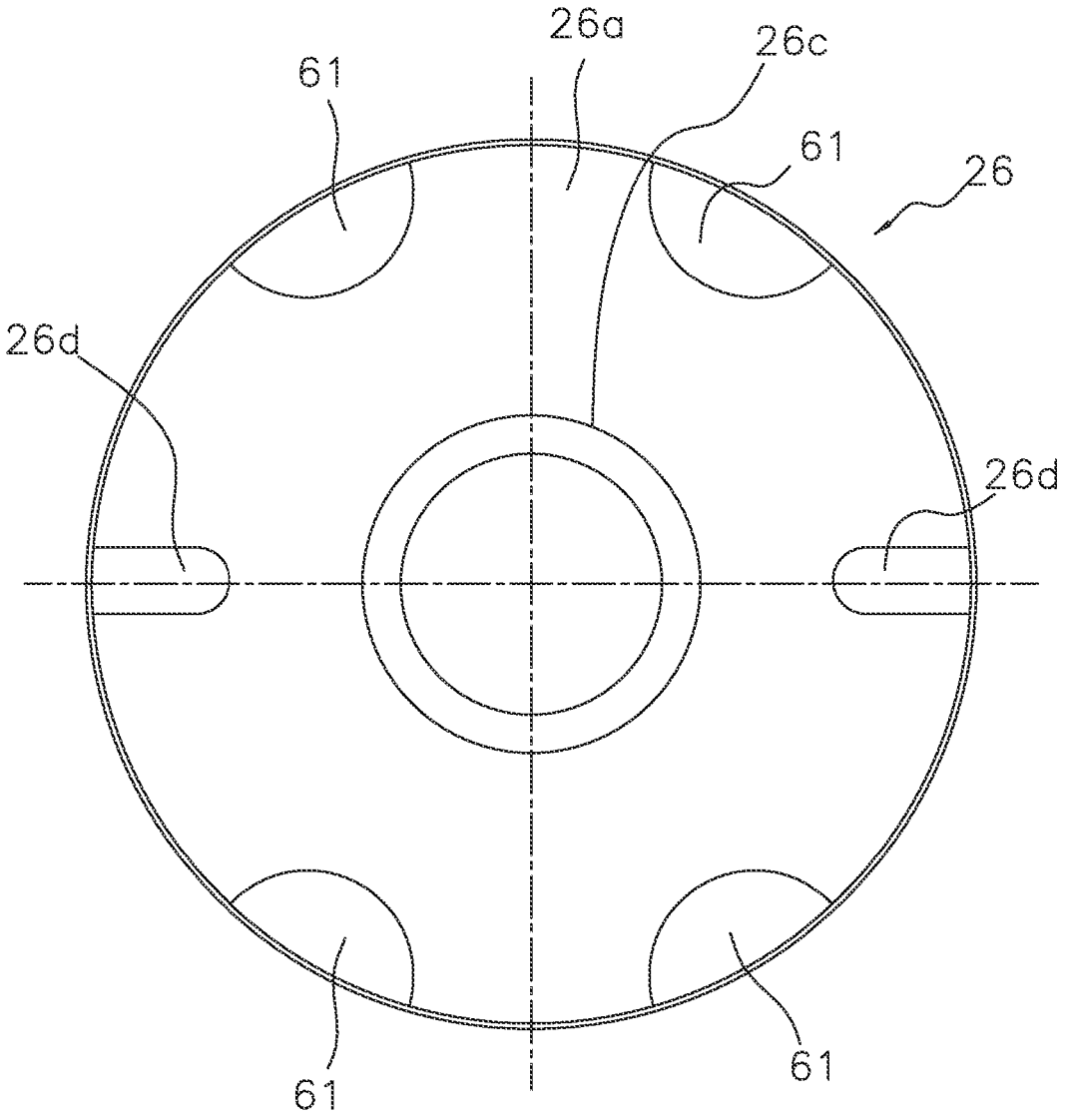
FIG. 8 is a top view representing the arrangement of the countersunk part formed on the back-surface side of the movable scroll of FIG. 1.

In order to reduce the weight of the movable scroll 26, as represented in FIG. 8, a plurality of countersunk parts 61 are formed on the surface of the plate of the movable scroll 26 on the side opposite where the lap 26*b* is formed, the countersunk parts formed in positions away from the key grooves 26*d*.

Figure 7:
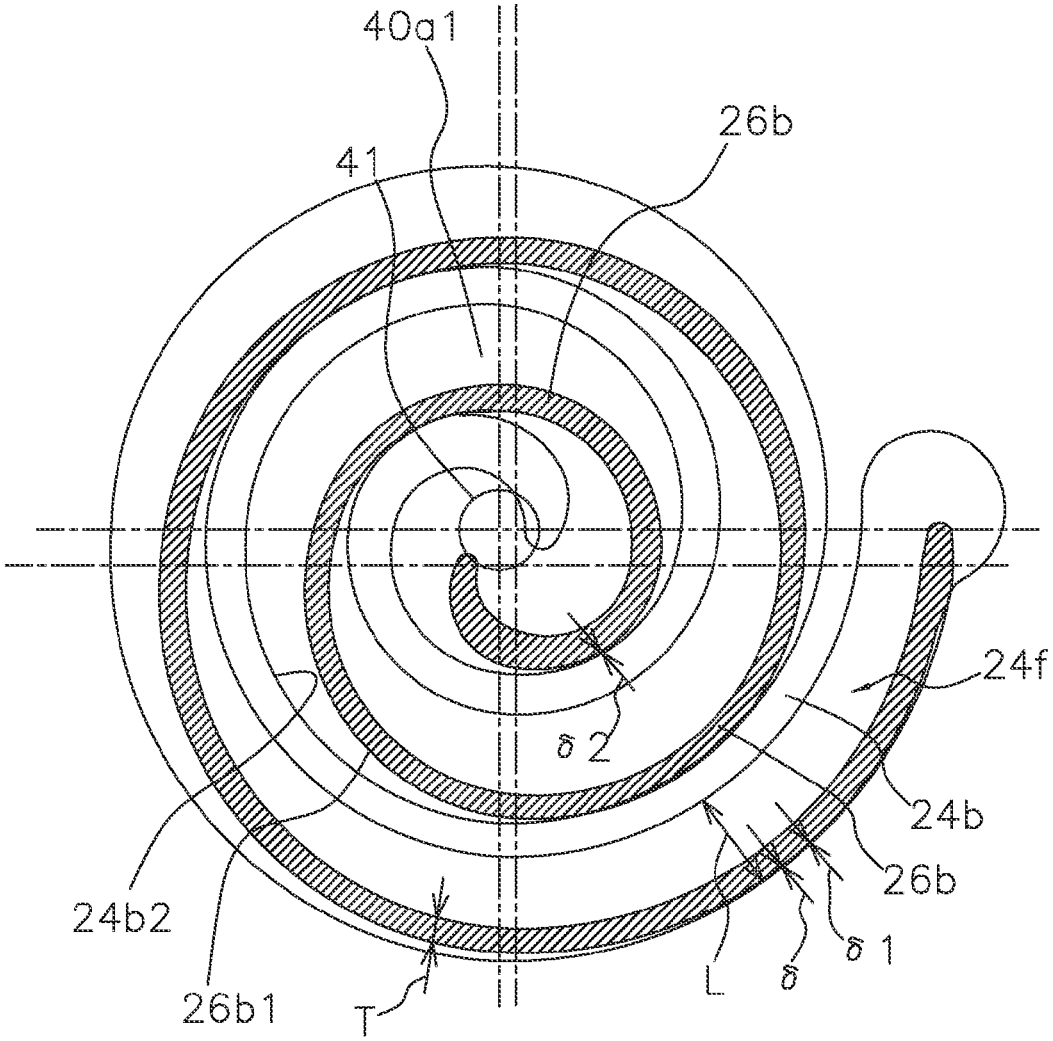
FIG. 7 is a top view representing the radial direction gap between the lap of the fixed scroll and the lap of the movable scroll of FIG. 1.

In order to relieve the contact loads at the winding end part 26*be* of the lap 26*b* of the movable scroll 26, as represented in FIG. 7, a radial direction gap δ1 between the outside peripheral surface 26*b*1 of the lap 26*b* of the movable scroll 26 and the inside peripheral surface 24*b*2 of the fixed scroll 24 in a range corresponding to one lap-turn from the winding end part 26*be* is made larger than a radial direction gap δ2 near the winding start part 26*bs*.

Specifically, as represented in FIG. 7, the radial direction gap δ between the inside peripheral surface 24*b*2 of the lap 24*b* of the fixed scroll 24 and the outside peripheral surface 26*b*1 of the lap 26*b* of the movable scroll 26 in the range corresponding to one lap-turn from the winding end part 26*be* of the lap 26*b* of the movable scroll 26 is set so as to fall within the range below (Formula 3).

As represented in FIG. 7, the radial direction gap δ is set so as to fall in the following range:

$$(L-T-D\times 2)\leq\delta\leq(L=T-D\times 2+P+M) \quad \text{(Formula 3)}$$

where:

L is the width of a groove 24*f* of the fixed scroll 24;

T is the wall thickness of the lap 26*b* of the movable scroll 26;

D is the turning radius of the movable scroll 26;

P is the pin bearing gap between the boss 26*c* of the movable scroll 26 and the pin shaft part 17*a* of the crankshaft 17 connected thereto; and M is the main bearing gap between the crankshaft 17 and the main bearing supporting the crankshaft 17; i.e., a bearing metal 34 of the housing 23.

(2-3) Housing

The housing 23 is securely press-fitted into the middle casing part 11 over the entirety of the circumferential direction of an outside peripheral surface of the housing 23. Specifically, the middle casing part 11 and the housing 23 are hermetically attached over the entire circumference. Therefore, an inside part of the casing 10 is partitioned into a high-pressure space 28 in a lower region of the housing 23, and a low-pressure space 29 in an upper region of the housing 23. The fixed 24 is securely fastened to the housing 23 by a bolt 38 so that an upper edge surface is tightly attached to a lower edge surface of the fixed scroll 24. A crank chamber 31 and a bearing part 32 are formed in the housing 23, the crank chamber provided as a recess in an upper surface center thereof, and the bearing part extending downward from a tower surface center thereof. A vertically penetrating bearing hole 33 is formed in the bearing part 32, and the crankshaft 17 is rotatably fitted in the bearing hole 33, interposed by a bearing metal 34.

(2-4) Other Components

A conduit channel 46 is formed in the scroll compression mechanism 15 extending between the fixed scroll 24 and the housing 23. The conduit channel 46 is formed so that the fixed scroll 24 communicates with a housing-side channel 48 formed as a notch in the housing 23. An upper edge of the conduit channel 46 opens onto an enlarged recess 42, and a lower edge of the conduit channel 46; i.e., a lower edge of the housing-side passage 48, opens onto the lower edge surface of the housing 23. Specifically, a discharge orifice 49 through which refrigerant in the conduit channel 46 is caused to flow into the gap 18 is constituted by the opening on the tower edge of the housing-side passage 48.

(3) Oldham Coupling

An Oldham coupling 39, as described above, is a member that prevents spin movement of the movable scroll 26, and is fitted into Oldham grooves (not shown) formed in the housing 23. The Oldham grooves are ovoid grooves disposed at opposing positions in the housing 23.

(4) Drive Motor

The drive motor 16 is a brushless DC motor in the present embodiment, and mainly comprises an annular stator 51 fixed to an inner wall surface of the casing 10, and a rotor 52 rotatably accommodated on the inside of the stator 51 interposed by a slight gap (air gap). An upper end of a coil end 53 formed on an upper side of the stator 51 is arranged on the drive motor 16 so as to be positioned at substantially the same height as a lower edge of the bearing part 32 of the housing 23.

A copper wire is wound around a toothed part on the stator 51, and the coil ends 53 is formed thereabove and therebelow. Notched core cut parts are provided in a plurality of locations on an outside peripheral surface of the stator 51, extending from an upper end surface of the stator 51 to a lower edge surface thereof, a predetermined gap being provided along a circumferential direction. A motor-cooling passage 55 extending in a vertical direction between the middle casing part lit and the stator 51 is formed by the core cut parts.

The rotor 52 is drivably connected to the movable scroll 26 of the scroll compression mechanism 15 by the crankshaft 17, which is arranged in the axial center of the middle casing part 11 so as to extend in a vertical direction. A guide plate 58 for guiding refrigerant flowing out from the discharge orifice 49 of the conduit channel 46 into the motor-cooling passage 55 is provided in the gap 18.

(5) Lower Main Bearing

A lower main bearing 60 is provided in a lower space below the drive motor 16. The lower main bearing 60 is fixed to the middle casing part 11, the lower main bearing 60 constituting a lower edge side bearing of the crankshaft 17, and supporting the crankshaft 17.

(6) Intake Tube

The intake tube 19 is used for introducing refrigerant from the refrigerant circuit into the scroll compression mechanism 15, the intake tube being hermetically fitted into the upper wall part 12 of the casing 10. The intake tube 19 penetrates the low-pressure space 29 in a vertical direction, an inner edge part of the intake tube being fitted into the fixed scroll 24.

(7) Discharge Tube

The discharge tube 20 is used for discharging refrigerant inside the casing 10 out from the casing 10, the discharge tube being hermetically fitted into the middle casing part 11 of the casing 10. The discharge tube 20 opens at a location where it protrudes downward centrally from the inner surface of the middle body.

Features of the Embodiment (1)

According to the scroll compressor 1 of the embodiment, the base radius of the involute is reduced (i.e., the wall thickness is reduced) only in the region extending from the winding start part 26*bs* of the lap 26*b* of the movable scroll 26 to the winding middle part 26*bm*, and a reduction in the size of the scroll compression mechanism 15 is achieved. In addition, by making the base radius of the involute larger in the other region extending from the winding middle part 26*bm* to the winding end part 26*be*, it is possible to ensure the wall thickness of the winding end part 26*be*, and improve the strength of the winding end part 26*be*.

(2)

Therefore, according to the scroll compressor 1 of the embodiment, when the centrifugal force of the movable scroll 26 increases during high-rotation operation and contact occurs between the movable scroll 26 and the fixed scroll 24, even if a large amount of centrifugal force acts on the winding end part 26*be* of the lap 26*b*, cracks or other defects of the lap 26*b* can be avoided since the winding end part 26*be* of the lap is of adequate strength. As a result, the strength of the winding end part 26*be* of the lap 26*b* can be improved, and the size of the scroll compression mechanism 15 can be reduced.

(3)

Specifically, according to the scroll compressor it of the embodiment, the strength of the lap 26*b* of the movable scroll 26 is improved, and the lap 26*b* is less likely to crack. In addition, the size of the scroll compression mechanism 15 is reduced and the performance of the lap 26*b* is improved.

As a result, an improvement in the strength of the lap 26*b* is achieved due to the shape of the lap 26*b*.

By fashioning the lap 26*b* so that the base radius of the involute decreases (the wall thickness becomes smaller) as the winding angle θ increases from the winding start part 26*bs* to the winding middle part 26*bm* of the lap 26*b*, the size of the scroll compression mechanism 15 can be reduced.

Since the scroll compressor 1 has a specific compression ratio due to its structure, it is possible to prevent the occurrence of cracking at the winding start part 26*bs* of the lap 26*b* even if large loads are applied during high-compression-ratio operation, or in other circumstances. In addition, the scroll compression mechanism 15 can be reduced in size.

Furthermore, the lap 26*b* is constituted such that the base radius of the involute increases (the wall thickness increases) as the winding angle θ of the lap 26*b* increases from the winding middle part 26*bm* of the lap 26*b* to the winding end part 26*be*. The wall thickness of the winding end part 26*be* of lap 26*b* is thereby increased, and the strength of the winding end part 26*be* is improved.

(4)

According to the scroll compressor 1 of the embodiment, furthermore, since the winding middle part 26*bm* of the lap 26*b* constitutes the range of the entire lap 26*b* excluding the portion of half lap-turn from the winding start part 26*bs* and the portion of half lap-turn from the winding end part 26*be* (the range of the diagonal-line portion), it is possible to reliably achieve a reduction in the size of the scroll compression mechanism 15 and an improvement in the strength of the winding end part 26*be*, (5)

According to the scroll compressor 1 of the embodiment, furthermore, the base radius R2 of the involute on the inside of the lap 26*b* decreases in the region S2 from the winding middle part 26*bm* to the winding end part 26*be* of the lap 26*b*, as represented in FIG. 2. Meanwhile, since the base radius R2 of the involute on the outside of the lap 26*b* increases, it is possible to achieve a reduction in the size of the scroll compression mechanism 15 and an improvement in the strength of the winding end part 26*be*.

(6)

Specifically, having the lap 26*b* constituted such that the base radius of the inside involute curve portion of the movable scroll 26 decreases from the winding middle part 26*bm* of the lap 26*b* to the winding end part 26*be*, the base radius of the outside involute curve portion increases. As a result, it is possible to reduce the size of the scroll compression mechanism 15 at the inside involute curve portion.

(7)

According to the scroll compressor 1 of the embodiment, furthermore, the lap 26*b* describes a shape such that, on the winding end part 26*be* of the lap 26*b*, the winding angle θ1 of the outer involute end point of the lap 26*b* is made less than the winding angle θ2 of the inner involute end point of the lap 26*b*.

As a consequence thereof, contact is made with a high-rigidity part on the outermost periphery of the lap 24*b* of the fixed scroll 24, and an extension portion is provided on an end edge of the lap 26*b* of the movable scroll 26 having a one-side-supported structure, whereby the lap 26*b* is supported on both sides at the winding end part 26*be* thereof. Therefore, stress generated at the base of the winding end part 26*be* of the lap 26*b* can be relieved. It is accordingly possible to relieve stress generated at the base of the winding end part 26*be* of the lap 26*b* of the movable scroll 26. As a result, it is possible to improve the strength of the winding end part 26*be* of the lap 26*b*.

Moreover, since it is possible to increase the built-in compression ratio of the compression chamber 40 formed by the lap 26*b* on the inside of the movable scroll 26, and reduce the pressure difference between the inside compression chamber and the outside compression chamber, leakage loss is reduced and efficiency can be improved.

(8)

According to the scroll compressor 1 of the embodiment, furthermore, a plurality of countersunk parts 61 are formed on the surface of the plate of the movable scroll 26 on the side opposite where the lap 26*b* is formed, the countersunk parts formed in positions away from the key grooves 26*d*. It is thereby possible to reduce the weight of the movable scroll 26.

Also, as described above, increasing the thickness of the winding end part 26*be* of the lap 26*b* of the movable scroll 26 increases the weight of the movable scroll 26 as well as the centrifugal force; however, it is possible to reduce the weight by forming the countersunk parts 61 in order to reduce the centrifugal force.

(9)

According to the scroll compressor 1 of the embodiment, furthermore, a radial direction gap δ1 between the outside peripheral surface 26*b*1 of the lap 26*b* of the movable scroll 26 and the inside peripheral surface 24*b*2 of the fixed scroll 24 in the range corresponding to one lap-turn from the winding end part 26*be* of the lap 26*b* of the movable scroll 26 is made larger than a radial direction gap δ2 near the winding start part 26*bs*.

(10)

According to the scroll compressor 1 of the embodiment, moreover, the radial direction gap δ between the outside peripheral surface 26*b*1 of the lap 26*b* of the movable scroll 26 in the range corresponding to one lap-turn from the winding end part 26*be* of the lap 26*b* of the movable scroll 26, and the inside peripheral surface 24*b*2 of the lap 24*b* of the fixed scroll 24, is set within the range given below (Formula 3).

As represented in FIG. 7, the radial direction gap δ is set so as to fall in the following range:

$$(L-T-D\times 2)\leq\delta\leq(L-T-D\times 2+P+M) \quad \text{(Formula 3)}$$

where:

L is the width of a groove 24*f* of the fixed scroll 24;

T is the wall thickness of the lap 26*b* of the movable scroll 26;

D is the turning radius of the movable scroll 26;

P is the pin bearing gap between the boss 26*c* of the movable scroll 26 and the pin shaft part 17*a* of the crankshaft 17 connected thereto; and M is the main bearing gap between the crankshaft 17 and the main bearing supporting the crankshaft 17; i.e., a bearing metal 34 of the housing 23.

By thus setting the radial direction gap δ, it is possible to reliably ensure the gap between the laps is 0 or more, and to reliably relieve the contact load.

Specifically, it is possible to relieve the contact load between the side of the winding end part 26*be* of the lap 26*b* of the movable scroll 26 and a high-rigidity portion (i.e., a thick part) of the lap 24*b* of the fixed scroll 24.

The width of the gap represented by (L−T−D×2) described above is 0 in an ideal state; however, in a case where processing error or assembly error result in contact being made between the lap 26*b* of the movable scroll 26 and the lap 24*b* of the fixed scroll 24, i.e., if the gap is 0 or lower, the lap 26*b* will have a clearance equating to the pin bearing gap and the main bearing gap.

If the radial direction gap δ of the lap 26*b* is increased excessively, the amount of compressed gas leaking from the compression chamber 40 through the radial direction gap δ will increase, leading to a drop in compressor performance. Consequently, in order to minimize any drop in performance, a suitable radial direction gap δ must be set. The radial direction gap δ is desirably set at 0, but is set to about 0 to 50 μm in actual manufacturing conditions.

According to the present embodiment, the radial direction gap δ at least at the seal point, which is a point where the laps 24*b*, 26*b* contact one another, is set so as to be approximately 0. Since a radial direction gap δ that is equal to or lower than a clearance at which the pin bearing gap and the main bearing gap are at a maximum is set in order to minimize any drop in performance, it is possible, as described above, to ensure the gap between the laps is reliably kept at 0 or higher.

It is thereby possible to relieve the contact loads received by the winding end part 26*be* of the lap 26*b* of the movable scroll 26 when contact is made with the high-rigidity portion (i.e., the thick portion) near the winding end part of the lap 24*b* of the fixed scroll 24.

Modifications (A)

According to the scroll compressor 1 of the embodiment described above, the base circle radius of the involute increases as the winding angle θ increases in the region of the lap 26*b* of the movable scroll 26 extending from the winding middle part 26*bm* to the winding end part 26*be*. However, it is also possible to have a spiral shape in which the base radius of the involute is greater than a minimum value of the base radius of the involute in the region extending from the winding start part 26*bs* to the winding middle part 26*bm*. It will still be possible to achieve an improvement in strength of the winding end part 26*be* of the lap 26*b* as well as a reduction in the size of the compression mechanism.

(B)

According to the scroll compressor 1 of the embodiment described above, the base radius of the involute increases as the winding angle θ increases in the region of the lap 26*b* of the movable scroll 26 extending from the winding middle part 26*bm* to the winding end part 26*be*. However, it is possible to have a spiral shape in which, as the winding angle θ increases, the base radius of the involute on the inside of the lap decreases and the base radius of the involute on the outside of the lap increases or becomes fixed; or, alternatively, to have a spiral shape in which, as the winding angle increases, the base radius of the involute on the inside of the lap becomes fixed, and the base radius of the involute on the outside of the lap increases or becomes fixed. It will still be possible to achieve an improvement in strength of the winding end part 26*be* of the lap 26*b* as well as a reduction in the size of the compression mechanism.

(C)

According to the scroll compressor 1 of the embodiment described above, the base radius of the involute increases as the winding angle θ increases in the region of the lap 26*b* of the movable scroll 26 extending from the winding middle part 26*bm* to the winding end part 26*be*. However, in the region extending from the winding middle part 26*bm* of the lap 26*b* to the winding end part 26*be*, it is possible for the base radius of the involute on the inside of the lap 26*b* to decrease as the winding angle θ increases, and the base radius of the involute on the outside of the lap 26*b* to increase or become fixed. It will still be possible to achieve an improvement in strength of the winding end part 26*be* of the lap 26*b* as well as a reduction in the size of the compression mechanism.

(D)

According to the scroll compressor 1 of the embodiment described above, the base radius of the involute is expressed as R2<R3<R1, and the wall thickness is expressed as t2<t3<t1. However, the base radius of the involute can also be expressed as R2<R1<R3, and the wall thickness can also be expressed as t2<t1<t3. It will still be possible to achieve an improvement in strength of the winding end part 26*be* of the lap 26*b* as well as a reduction in the size of the compression mechanism.

(E)

According to the scroll compressor 1 of the embodiment described above, the winding middle part 26*bm* of the lap 26*b* ranges from the inside edge part 26*bm* 1 to the outside edge part 26*bm*2; however, it can also assume a smaller range. For example, the inside edge part 26*bm*1 can be a point advanced by a desired amount within a range of a half-rotation to one rotation along the involute curve from the involute start point towards the involute end point. An outer middle point can be a point advanced by a desired amount within a range of a half rotation to one-rotation along the involute curve from the involute end point towards the involute start point. It will still be possible to achieve an improvement in strength of the winding end part 26*be* of the lap 26*b* as well as a reduction in the size of the compression mechanism.

(F)

Figure 10:
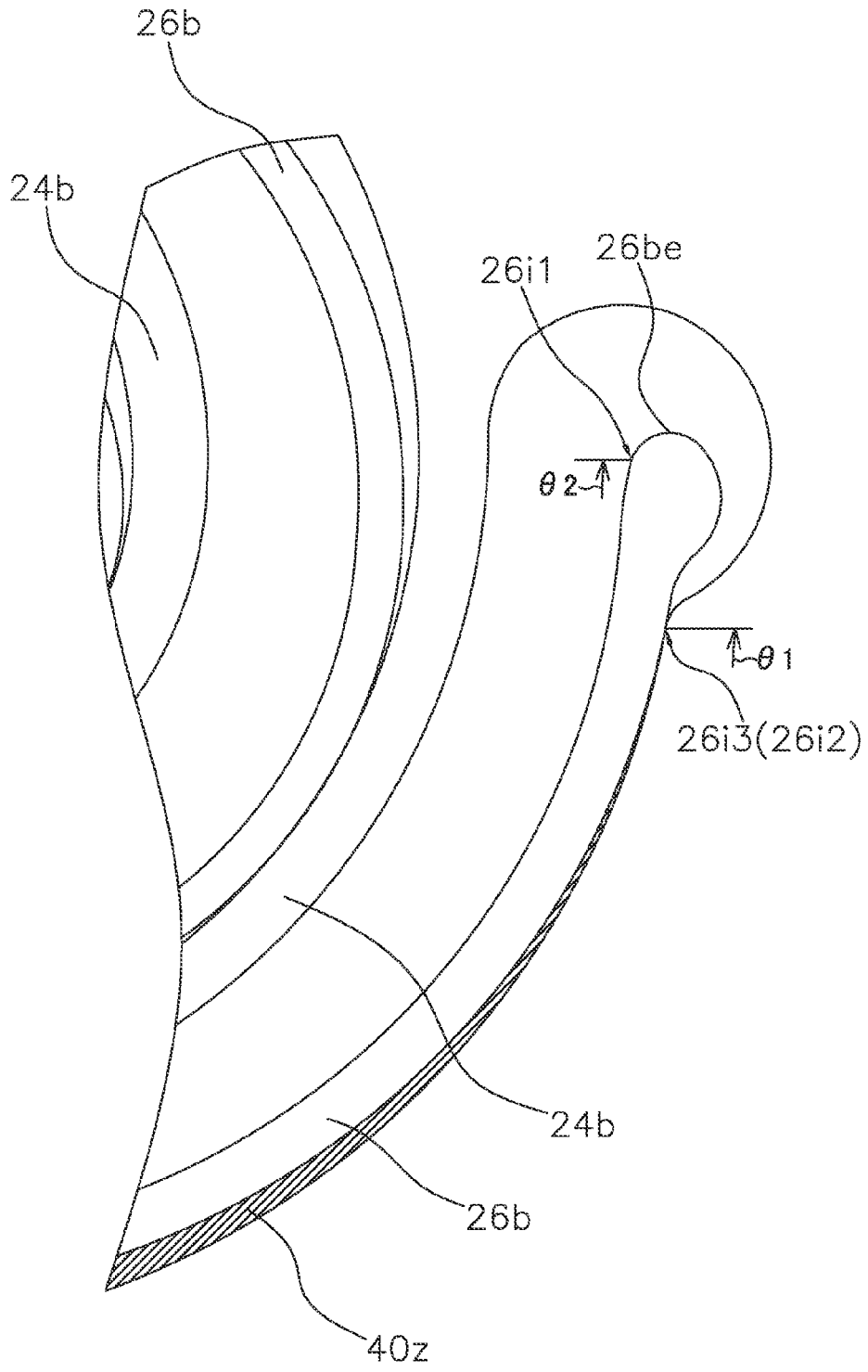
FIG. 10 is an enlarged view of the vicinity of the compression chamber formed on the outermost side of the lap of the movable scroll according to modification (F) of the present invention.

According to the scroll compressor 1 of the embodiment described above, as represented in FIG. 9, the compression-chamber-formation point 26*i*3 is different from the outer involute end point 26*i*2 of the lap 26*b*; however, the compression-chamber-formation point 26*i*3 can be the same as the outer involute end point 26*i*2 of the lap 26*b*. According to the present modification, as represented in FIG. 10, the region between the compression-chamber-formation point 26*i*3 and the winding end part 26*be* of the lap 26*b*, which has no relation to the formation of the compression chamber, does not have to describe an involute shape. It will still be possible to achieve an improvement in strength of the winding end part 26*be* of the lap 26*b* as well as a reduction in the size of the compression mechanism.

(G)

According to the embodiment as described above, changing the shape of the lap 26*b* of the movable scroll 26 makes it possible to achieve an improvement in strength of the winding end part 26*be* of the lap 26*b* as well as a reduction in the size of the compression mechanism; however, it is also possible to change the shape of the lap 24*b* of the fixed scroll 24 in the same way as in the embodiment described above. It will still be possible to achieve an improvement in strength of the lap 24*b* of the fixed scroll 24 as well as a reduction in the size of the compression mechanism.

INDUSTRIAL APPLICABILITY

The present invention can have widespread application as a scroll compressor, and makes it possible to improve the strength of the laps while reducing the size of the compression mechanism.

What is claimed is:

1. A scroll compressor comprising:

a fixed scroll having a spiral lap placed on one surface of a plate; and a movable scroll having a spiral lap placed on one surface of a plate, the lap of the fixed scroll and the lap of the movable scroll being interlocked to form a compression chamber between the lap of the fixed scroll and the lap of the movable scroll which are adjacent to each other, and at least one of the laps of the fixed scroll and the movable scroll having a spiral shape in which a base radius of an outer involute of the lap decreases as a winding angle increases in a region extending from a winding start point of the lap to a winding middle part of the lap, a spiral shape in which the base radius of the outer involute of the lap in a region extending from the winding middle part of the lap to a winding end point of the lap is larger than the smallest value of the base radius of the outer involute of the lap in the region extending from the winding start point of the lap to the winding middle part of the lap, a thickness of the lap continuously decreasing from a point between the winding start point of the lap and an inside edge point of the winding middle part in a radial direction of the lap to a thinnest point of the winding middle part of the lap and continuously increasing from the thinnest point of the winding middle part of the lap to a point between the winding end point of the lap and an outside edge point of the winding middle part in the radial direction of the lap, the winding middle part of the lap being a range of the entire lap excluding a range corresponding to a half lap-turn from the winding start point and a range corresponding to a half lap-turn from the winding end point, the inside edge point being a point positioned a half lap-turn away from an outer involute start point of the lap toward an outer involute end point of the lap, and the outside edge point being a point positioned a half lap-turn away from the outer involute end point of the lap toward the outer involute start point of the lap.

2. The scroll compressor according to claim 1, wherein the at least one of the laps of the fixed scroll and the movable scroll extends forms a spiral shape in which a winding angle at a compression-chamber-forming point is smaller than a winding angle at an inner involute end point of the lap, the compression-chamber-forming point being a point where an outermost compression chamber is formed, the point being included in the outer involute of the lap, the point being a point where the lap of the movable scroll and the lap of the fixed scroll contact, and the outermost compression chamber being positioned on an outermost part of the plate in a radial direction.

3. The scroll compressor according to claim 1, wherein a countersunk part is formed on a surface of the plate of the movable scroll, with the surface being on the opposite side of the surface where the lap is placed.

4. The scroll compressor according to claim 1, wherein a radial direction gap is formed between an inner peripheral surface of the lap of the fixed scroll and an outer peripheral surface of the lap of the movable scroll, and the radial direction gap in a range corresponding to one lap-turn from the winding end point of the lap of the movable scroll is larger than the radial direction gap near the winding start point of the movable scroll.

5. The scroll compressor according to claim 4, wherein the radial direction gap is δ in a range corresponding to one lap-turn from the winding end point of the lap of the movable scroll, and δ is in a range that satisfies the expression $$(L-T-D\times 2)\leq\delta\leq(L-T-D\times 2+P+M),$$ where L is a groove width of the fixed scroll, T is a wall thickness of the movable scroll, D is a turning radius of the movable scroll, P is a pin bearing gap between a boss of the movable scroll and a pin shaft part of a crankshaft connected thereto, and M is a main bearing gap between the crankshaft and a bearing metal supporting the crankshaft.

6. A scroll compressor comprising:

a fixed scroll having a spiral lap placed on one surface of a plate; and a movable scroll having a spiral lap placed on one surface of a plate, the lap of the fixed scroll and the lap of the movable scroll being interlocked to form a compression chamber between the lap of the fixed scroll and the lap of the movable scroll which are adjacent to each other, and at least one of the laps of the fixed scroll and the movable scroll having a spiral shape in which a base radius of an outer involute of the lap decreases as a winding angle increases in a region extending from a winding start point of the lap to a winding middle part of the lap, in a region extending from the winding middle part of the lap to a winding end point of the lap, a spiral shape in which a base radius of an inner involute of the lap decreases and a base radius of the outer involute of the lap either increases or stays constant as the winding angle increases or a spiral shape in which the base radius of the inner involute of the lap stays constant and the base radius of the outer involute of the lap either increases or stays constant as the winding angle increases, a thickness of the lap continuously decreasing from a point between the winding start point of the lap and an inside edge point of the winding middle part in a radial direction of the lap to a thinnest point of the winding middle part of the lap and continuously increasing from the thinnest point of the winding middle part of the lap to a point between the winding end point of the lap and an outside edge point of the winding middle part in the radial direction of the lap, the winding middle part of the lap being a range of the entire lap excluding a range corresponding to a half lap-turn from the winding start point and a range corresponding to a half lap-turn from the winding end point, the inside edge point being a point positioned a half lap-turn away from an outer involute start point of the lap toward an outer involute end point of the lap, and the outside edge point being a point positioned a half lap-turn away from the outer involute end point of the lap toward the outer involute start point of the lap.

7. The scroll compressor according to claim 6, wherein the at least one of the laps of the fixed scroll and the movable scroll extends forms a spiral shape in which a winding angle at a compression-chamber-forming point is smaller than a winding angle at an inner involute end point of the lap, the compression-chamber-forming point being a point where an outermost compression chamber is formed, the point being included in the outer involute of the lap, the point being a point where the lap of the movable scroll and the lap of the fixed scroll contact, and the outermost compression chamber being positioned on an outermost part of the plate in a radial direction.

8. The scroll compressor according to claim 6, wherein a countersunk part is formed on a surface of the plate of the movable scroll, with the surface being on the opposite side of the surface where the lap is placed.

9. The scroll compressor according to claim 6, wherein a radial direction gap is formed between an inner peripheral surface of the lap of the fixed scroll and an outer peripheral surface of the lap of the movable scroll, and the radial direction gap in a range corresponding to one lap-turn from the winding end point of the lap of the movable scroll is larger than the radial direction gap near the winding start point of the movable scroll.

10. The scroll compressor according to claim 9, wherein the radial direction gap is δ in a range corresponding to one lap-turn from the winding end point of the lap of the movable scroll, and δ is in a range that satisfies the expression $$(L-T-D\times 2)\leq\delta\leq(L-T-D\times 2+P+M),$$ where L is a groove width of the fixed scroll, T is a wall thickness of the movable scroll, D is a turning radius of the movable scroll, P is a pin bearing gap between a boss of the movable scroll and a pin shaft part of a crankshaft connected thereto, and M is a main bearing gap between the crankshaft and a bearing metal supporting the crankshaft.

* * * * *